US006607107B2

(12) United States Patent
Dexheimer

(10) Patent No.: US 6,607,107 B2
(45) Date of Patent: Aug. 19, 2003

(54) BACKPACK AND IMPROVED LOAD-CARRYING SYSTEM THEREFOR

(75) Inventor: Lee Dexheimer, Portland, OR (US)

(73) Assignee: Bonfire Snowboarding, Inc., Portland, OR (US)

( * ) Notice: Subject to any disclaimer, the term of this patent is extended or adjusted under 35 U.S.C. 154(b) by 0 days.

(21) Appl. No.: 09/773,564

(22) Filed: Feb. 2, 2001

(65) Prior Publication Data

US 2002/0104862 A1 Aug. 8, 2002

(51) Int. Cl.[7] ..... A45C 13/30

(52) U.S. Cl. ..... 224/604; 224/605; 224/630; 224/637; 224/641; 224/643; 224/644; 224/262

(58) Field of Search ..... 224/602, 603, 224/604, 605, 630, 637, 640, 641, 642, 643, 644, 645, 259, 262

(56) References Cited

U.S. PATENT DOCUMENTS 5,240,159 A * 8/1993 Gregory ..... 224/264
5,607,092 A * 3/1997 Alexander ..... 224/258
5,862,526 A * 1/1999 Longcor et al. ..... 2/247
5,890,640 A * 4/1999 Thompson ..... 224/153
6,024,265 A * 2/2000 Clements ..... 224/259
6,070,776 A * 6/2000 Furnary et al. ..... 224/627
6,375,053 B1 * 4/2002 Cecchinel ..... 224/264

FOREIGN PATENT DOCUMENTS

GB 2130481 6/1984

* cited by examiner

*Primary Examiner*—Stephen K. Cronin
(74) *Attorney, Agent, or Firm*—Greenblum & Bernstein, P.L.C.

(57) ABSTRACT

A load-carrying system for a backpack, and a backpack including such load-carrying system. The load-carrying system includes an improved structure, particularly for use during the practice of various sports, more particularly for gliding sports, such as snowboarding, skiing, and in-line skating. The invention includes an improved backpack and load-carrying system adapted to be held in place in order to prevent any interference with the user's ride.

21 Claims, 3 Drawing Sheets

BACKPACK AND IMPROVED LOAD-CARRYING SYSTEM THEREFOR

BACKGROUND OF THE INVENTION

1. Field of the Invention

This invention relates to backpacks and to the load carrying system or harness thereof.

2. Description of Background and Relevant Information

Backpacks fall into two main categories, these being soft or formless packs, and those having a frame.

One important criterion with either type of pack is that the pack is comfortable to carry, especially when the pack is fully laden, and it is therefore important that the pack adapts itself to the shape of the back of the user.

Another important aspect is that the backpack does not prevent freedom of movements of the shoulders and/or hips of the user. This aspect is particularly important for backpacks used during the practice of a gliding sport, such as snowboarding, in-line skating, skiing, etc., especially during riding.

For example during the practice of snowboarding, extreme body motions such as bending, contorting, and twisting of the upper body occur during riding downhill.

It is therefore important that the backpack does not prevent or hinder these motions in order not to impede the ride.

Some solutions have already been proposed to solve the problem of free movement, particularly for the shoulders.

For example the document GB 2130481 describes a load-carrying system, wherein the shoulder straps have their lower ends interconnected by a strap which is slidingly coupled to either the frame of the pack or to the body of the pack.

Other documents describe a similar construction with a sliding strap. However, in all these embodiments the strap must stay flat during sliding, which is difficult especially when extreme motions of the body of the user occur. Therefore, these systems do not function very properly due to the limited ability of the strap to slide in all positions.

Others documents, especially relating to frame packs, disclose a pivotal interconnection between the shoulder straps and the frame and/or between the belt or hip strap and the frame.

However such frame packs are heavy, cumbersome and not at all adapted to a ride with extreme body motions such as in snowboarding.

SUMMARY OF THE INVENTION

It is therefore an object of this invention to provide an improved backpack structure.

It is another object of this invention to provide an improved backpack, especially adapted to the practice of a gliding sport such as snowboarding, wherein extreme body motions like bending, contorting, and twisting of the upper body occur.

It is still another object of this invention to provide an improved backpack and load-carrying system adapted to hold the package in place in order to prevent any interference of loads with the ride.

With these and other objects in view, which will become apparent to one skilled in the art as the description proceeds, this invention resides in the novel construction, combination, arrangement of parts and method substantially as hereinafter described and more particularly defined by the appended claims, it being understood that changes in the precise embodiments of the herein disclosed invention are meant to be included within the scope of the claims.

BRIEF DESCRIPTION OF THE DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

Figure 1:
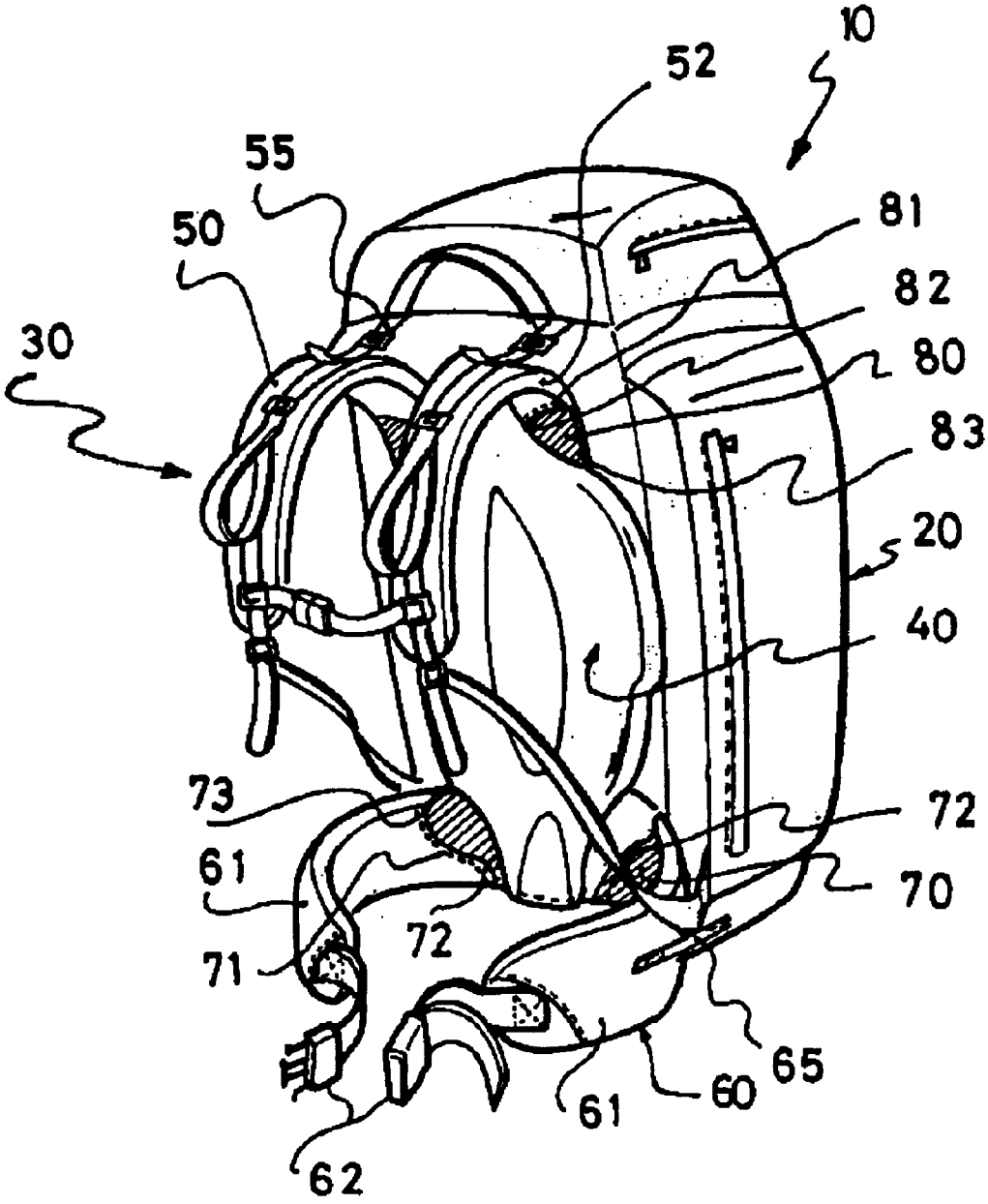
FIG. 1 is a rear perspective view of a backpack incorporating a load-carrying system according to the invention.

With initial reference to FIG. 1, the backpack 10 generally comprises a pack body 20 for receiving the loads and a load-carrying system 30 attached to the pack body and arranged to be positioned on the user's torso.

The load-carrying system 30 comprises a back panel 40 which is secured to the pack body 20, in a manner known per se, a shoulder harness assembly 50 and a hip or waist harness assembly 60.

The hip harness assembly 60 comprises two belt elements 61, which can be secured around the hip/waist of the user via adjustable fastening mechanism 62.

Each belt element 61 is attached to the back panel 40 via a first connecting device.

The insert 70 of the first connecting device includes an elastic insert stitched between each of the belt elements 61 and the back panel 40.

The insert 70 of the first connecting device is preferably made of an elastic material, such as a neoprene fabric, stitched via seams 71 to the back panel 40 and to the belt element 61. In the preferred embodiment, the neoprene fabric used is a closed cell neoprene of at least 2 millimeters thickness such as used in wet suits.

Preferably, each insert 70 has a triangular or semi-circular shape, in order to define at its apex 72 a rotation point in relation to which the insert 70 can stretch elastically in a generally longitudinal direction, corresponding to the edge 73 opposite to its apex 72, in relation to the respective belt element 61, in order to enable a rotational movement (see arrow R in FIG. 2) of the respective belt elements 61 in relation to the back panel 40.

Thus, a pivotal connection is produced between each belt element 61 and the back panel 40.

The same construction also applies to the connection between the shoulder harness assembly 50 and the back panel 40.

The shoulder harness assembly 50 comprises two shoulder straps 51 which are fixed at their upper end 52, to the top extremity 41 of the back panel 40 via a second connecting device, and are fixed at their lower end 53 to the bottom extremity of the back panel 40.

As with the first connecting device, which included an insert 70, the second connecting device includes an elastic insert 80 stitched between each of the shoulder straps 51 and the back panel 40. Each elastic insert 80 is preferably made of an elastic material, such as a neoprene fabric stitched via seams 81 to the backpack 40 and to the shoulder straps 51.

Preferably, each insert 80 of the second connecting device has a triangular or semi-circular shape in order to define at its apex 82 a rotation point, in relation to which the insert 80 can stretch elastically in a generally longitudinal direction corresponding to its edge 83 opposite to the apex 82. Thus, a pivotal or rotational connection (see arrow R in FIG. 2) of each shoulder strap 51 in relation to the back panel is produced.

The pivotal connection of each shoulder and hip harness system to the back panel allows a particularly good adaptation of the back pack to the movements of the body and torso during the practice of gliding sports, such as snowboarding, wherein extreme body motions like bending, contorting, and twisting of the upper body occur.

Additional structural arrangements are provided to further increase the ability of the backpack to follow the body motions.

First, each insert 70, 80 can be part of a single elastic panel 90. See FIGS. 3 and 4, for example.

The elastic panel 90 extends from the top extremity 41 of the back panel to the bottom extremity 42 thereof.

It is stitched to the extremities by seams 91, 92.

The elastic panel 90 is further slidably mounted within a vertical channel 43 of back panel 40 defined by a vertical stitching 44, thus the elastic panel 90 can further stretch to follow bending movements of the torso and provide a "free floating" effect.

As will be easily understood, the rotational movement by stretching of neoprene inserts 70, 80 is limited by the elongation limit of the material constituting such inserts. However other structural arrangements can be used to further limit the rotational or the floating effect and/or adapt it to the user's preference, Such arrangements are provided, for example, by load lift straps 55, 65 (see FIG. 1) which connect the top and bottom of the pack body 20, respectively, to the harness assembly 50 and the hip harness assembly 60. Such lift straps 55, 65 are known per se and are conventionally used to distribute and adjust the load of the pack body 20 to the load carrying system and are therefore not described in detail hereafter.

The load lift straps 55, 65 can be used to define a rotational center different from the ones of apex 72, 82; they can also be used to limit the pivotal movement generated by the elastic inserts 70, 80.

In a preferred embodiment of the invention, a gripper material 100 such as rubber is provided on the internal face at the extremity of each shoulder strap 51 and belt element 61, in order to reduce shifting or slipping of the shoulder strap 51 and belt element 61 in relation to the user and thus allow an optimum adaptation of the backpack to the movements of the user.

Figure 3:
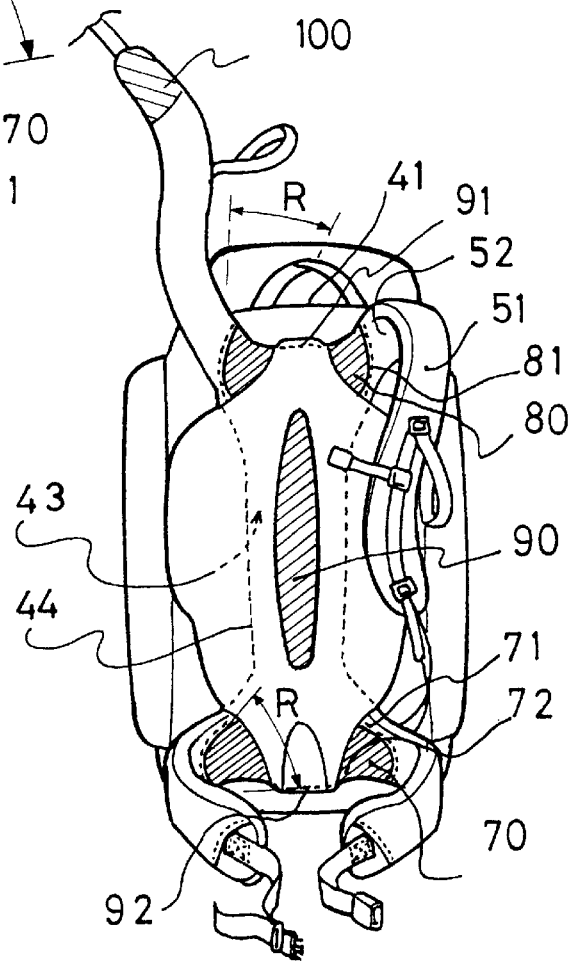
FIG. 3 is a rear elevation view of a backpack showing a load-carrying system according to a second embodiment of the invention.
Figure 4:
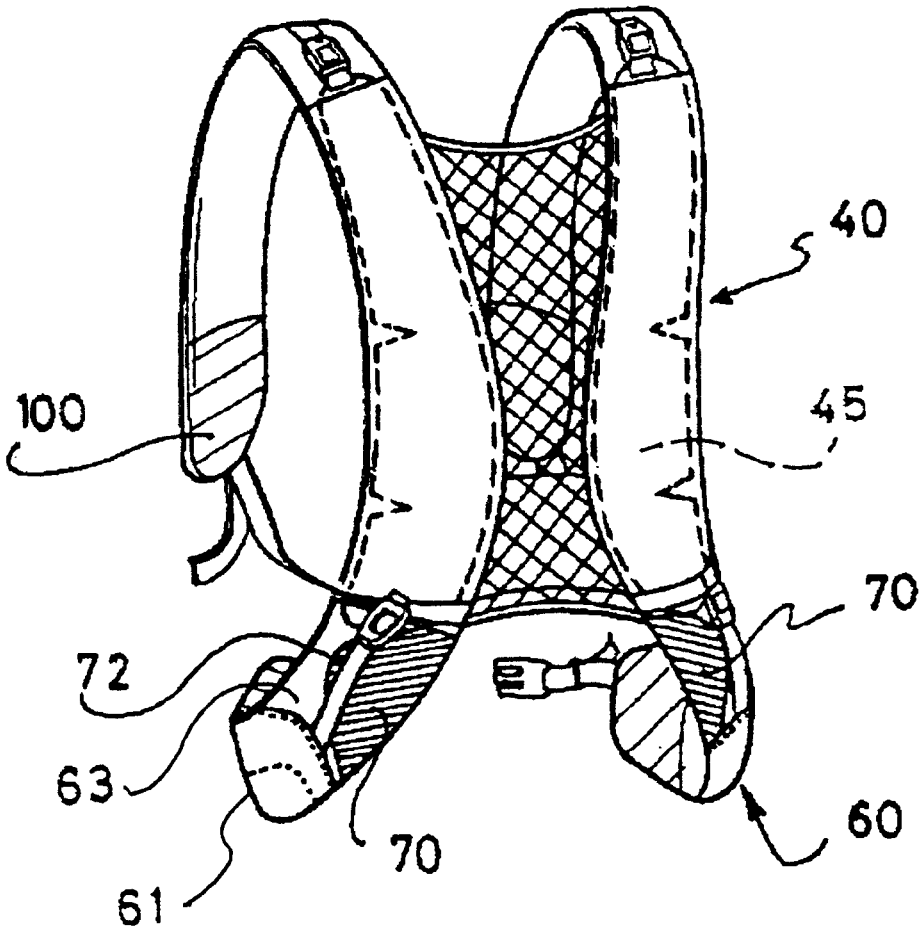
FIG. 4 is front elevation view a load carrying system according to a third embodiment of the invention.

With reference now to FIGS. 3 and 4, other embodiments of the invention are shown, wherein similar elements are designated by the same numeral references.

Figure 2:
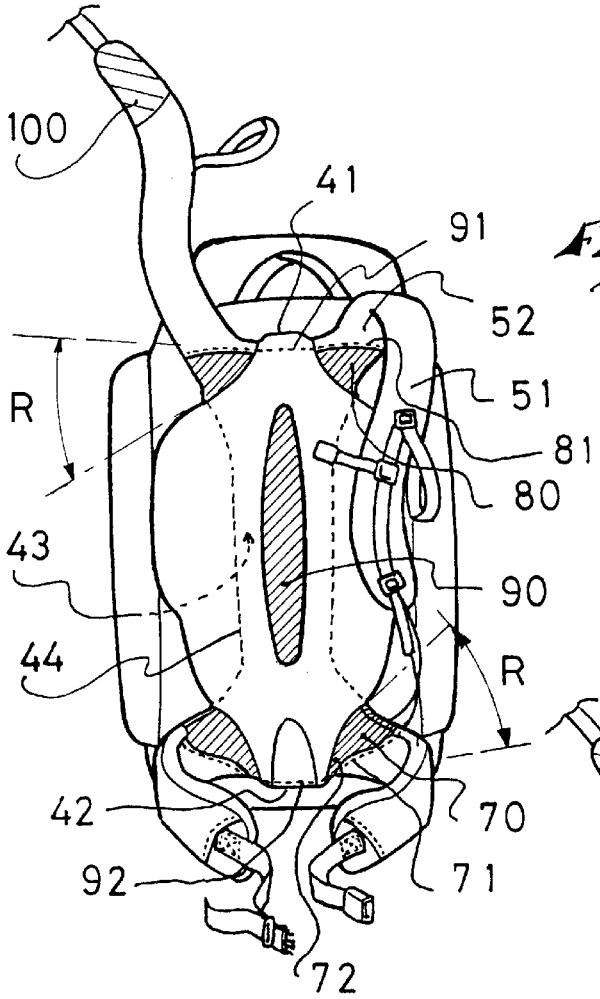
FIG. 2 is a rear elevation view of the backpack, showing the load-carrying system of FIG. 1.

The main difference between the backpack 10 of FIG. 3 and the backpack 10 of FIGS. 1 and 2 lies in the emplacement of each elastic insert 70, 80. Whereas in the embodiment of FIGS. 1 and 2, the edge 73, 83 of each insert 70, 80 is situated toward the lateral side of each connection back panel 40/shoulder strap 51 or belt element 61, in the embodiment of FIG. 3 the edges 73, 83 are placed, on the contrary, on a medial side of each connection of the back panel 40 shoulder strap 51 or belt element 61. Consequently, the apex 72, 82 of each insert is placed opposite in the vertical direction, although the rotational movement R is substantially the same.

In the embodiment of FIG. 4, elastic inserts 70 are only provided at the interconnection zone between the hip harness assembly 60 and the back panel 40.

These inserts 70 have a semi-circular shape and are further limited on one side by a strip of material 63 extending from the belt element 61 which defines the apex 72. As the strip of material 63 is substantially non-extensible, it defines the rotation center for the elastic insert 70.

Furthermore, two internal sheet stiffeners 45 are provided laterally on each side of the back panel 40 to provide transverse rigidity, while allowing flexibility in the longitudinal directions.

Such stiffeners are made of a supple, non-extensible material, such as a sheet of PE (polyethylene) in order to provide the aforementioned transverse rigidity. This last embodiment is more particularly adapted to snowboard riding, as hip movements in this type of sport are particularly important.

However, all combinations of the above described embodiments can be considered in order to provide for a better adaptation of the backpack to the type of ride.

As can be appreciated from the foregoing, the present invention provides for a load-carrying system and associated backpack which allows a maximum range of hip and shoulder motion, and comfort to a user while maintaining and/or enhancing stability of the pack body while in use.

The invention is not limited to the use in snowboarding, but can be applied to all sports requiring motions of the body.

What is claimed is:

1. A load-carrying system for a backpack comprising a a back panel;

a shoulder harness assembly;

a hip harness assembly;

a first connecting device connecting said hip harness assembly to said back panel;

a second connecting device connecting said shoulder harness assembly to said back panel;

at least one of said first connecting device and said second connecting device comprising an insert, said insert being made of an elastic material enabling a pivotal connection of said hip or shoulder harness assembly to said back panel.

2. A load-carrying system according to claim 1, wherein: said elastic material is a multi-directional stretchable material.

3. A load-carrying system according to claim 1, wherein: said insert has a shape including an apex, and said hip or shoulder harness is pivotal about said apex.

4. A load-carrying system according to claim 1, wherein: said elastic insert comprises an elastomeric material.

5. A load-carrying system according to claim 4, wherein: said elastomeric material is neoprene.

6. A load-carrying system according to claim 1, wherein: said back panel comprises lateral sheet stiffeners.

7. A load-carrying system according to claim 6, wherein: each said sheet stiffener is flexible in a transverse direction.

8. A load-carrying system according to claim 1, wherein:

at least one of said hip harness assembly and said shoulder harness assembly comprises a gripping means.

9. A load-carrying system according to claim 8, wherein:

each said harness assembly comprises gripping zones for cooperation with the body of a wearer.

10. A load-carrying system according to claim 1, wherein:

a non-extensible fabric is associated laterally to each said insert.

11. A load-carrying system according to claim 10, wherein:

said elastic insert comprises an elastomeric material.

12. A load-carrying system according to claim 11, wherein:

said elastomeric material is neoprene.

13. A load-carrying system according to claim 1, wherein:

each of said first and second connecting devices comprises an elastic insert.

14. A load-carrying system according to claim 13, wherein:

each of said first and second connecting devices are integral with a back elastic panel extending from said first connecting device to said second connecting device.

15. A load-carrying system according to claim 14, wherein:

said back elastic panel is mounted for movement within a vertical channel of said back panel.

16. A load-carrying system according to claim 14, wherein:

said back elastic panel is positioned within a vertical channel of said back panel, said back elastic panel being attached to said back panel only at top and bottom extremities of said back panel.

17. A load-carrying system according to claim 14, wherein:

said back elastic panel is slidably mounted within said back panel.

18. A load-carrying system according to claim 17, wherein:

said back elastic panel is affixed to said back panel at a bottom and at a top thereof.

19. A backpack comprising a load-carrying system, said backpack comprising:

a pack body; and a load-carrying system attached to said pack body, said load-carrying system comprising:

a back panel;

a shoulder harness assembly;

a hip harness assembly;

a first connecting device connecting said hip harness assembly to said back panel;

a second connecting device connecting said shoulder harness assembly to said back panel;

at least one of said first connecting device and said second connecting device comprising a pivotal connection between back panel and one of said hip or shoulder harness, said pivotal connection comprising an elastic insert.

20. A backpack according to claim 19, wherein:

said elastic material is a multi-directional stretchable material.

21. A backpack according to claim 19, wherein:

said insert has a shape including an apex, and said hip or shoulder harness is pivotal about said apex.

* * * * *